United States Patent [19]

Fushida et al.

[11] Patent Number: 4,576,465

[45] Date of Patent: Mar. 18, 1986

[54] METHOD AND APPARATUS FOR ADJUSTING TONER CONCENTRATION OF TWO-COMPONENT TYPE DEVELOPER

[75] Inventors: Akira Fushida, Suita; Yuuji Hasegawa, Kishiwada; Toshikazu Matsui, Nishinomiya, all of Japan

[73] Assignee: Mita Industrial Co., Ltd., Osaka, Japan

[21] Appl. No.: 535,637

[22] Filed: Sep. 26, 1983

[30] Foreign Application Priority Data

Sep. 24, 1982 [JP] Japan ..... 57-165062

[51] Int. Cl.[4] ..... G03G 15/09

[52] U.S. Cl. ..... 355/3 DD; 118/657; 118/658; 355/14 D

[58] Field of Search ..... 355/3 R, 3 DD, 14 D; 118/656, 657, 658, 661

[56] References Cited

U.S. PATENT DOCUMENTS

| | | | |
|---|---|---|---|
| 3,453,045 | 7/1969 | Fantuzzo | 355/3 DD |
| 3,542,466 | 11/1970 | Fox et al. | 355/3 DD |
| 3,790,397 | 2/1974 | Weiler | 355/3 DD X |
| 4,054,381 | 10/1977 | Bernhard | 355/3 DD X |
| 4,113,371 | 9/1978 | Fraser et al. | 355/3 DD X |

FOREIGN PATENT DOCUMENTS 5792355 6/1982 Japan .

*Primary Examiner*—Fred L. Braun

*Attorney, Agent, or Firm*—Sherman and Shalloway

[57] ABSTRACT

The toner concentration of a two-component type developer including a mixture of a magnetic carrier and an electroscopic toner is adjusted by bringing a magnetic brush of the two-component type developer into sliding contact with a mesh screen to move the electroscopic toner toward the magnetic brush side or the opposite side through apertures of the mesh screen. Apparatus for adjusting the toner concentration in a two-component type developer includes a mechanism for forming a magnetic brush from a mixture of a magnetic carrier and an electroscopic toner and for delivering the magnetic brush. The mechanism includes a support formed of an electroconductive non-magnetic material and a magnet having a plurality of poles and being built in the interior of the support. At least one of the support and magnet is movable. A mesh screen is formed of an electroconductive material and is arranged to support the electroscopic toner on the upper surface side thereof and to have sliding contact with the magnetic brush on the lower surface side thereof. A bias voltage applying mechanism is provided for applying a bias voltage between the support and mesh screen.

6 Claims, 8 Drawing Figures

METHOD AND APPARATUS FOR ADJUSTING TONER CONCENTRATION OF TWO-COMPONENT TYPE DEVELOPER

BACKGROUND OF THE INVENTION (1) Field of the Invention:

The present invention relates to a method and apparatus for adjusting the toner concentration a two-component type developer. More particularly, the present invention relates to a method and apparatus for precisely and freely adjusting the toner concentration within a broad range on a magnetic brush in which a two-component type magnetic developer is actually used for the development.

(2) Description of the Prior Art:

In the electrophotographic process or electrostatic recording process, an electrostatic latent image is formed on a photosensitive material or recording material and this electrostatic latent image is brought into contact with a developer to form a visible image corresponding to the electrostatic latent image. For the development of the electrostatic latent image, a two-component type developer comprising a magnetic carrier composed of iron powder and an electroscopic toner comprising resin binder particles containing a pigment dispersed therein in widely used because the development operation is facilitated with the use of this two-component type developer. If these two components of the developer are mixed, the toner particles are frictionally charged with an inherent charge and they are held on the surface of the magnetic carrier. If this two-component type developer in the form of a magnetic brush is brought into sliding contact with a substrate bearing an electrostatic latent image, the toner particles are attracted to the electrostatic latent image to form a toner image.

The two-component type developer is advantageous in that the development operation is facilitated as described above and the quality of the formed image is ordinarily good. However, the two-component type developer is defective in that while the development operation is continued, the toner concentration in the developer is gradually reduced and it is difficult to adjust the toner concentration at a certain level. More specifically, with reduction of the toner concentration in the developer, the density of the formed image is correspondingly reduced. On the other hand, if the toner concentration is too high, such troubles as adhesion of the toner to the background (non-image area) and scattering of the toner from a magnetic brush roller are caused.

Accordingly, reduction of the toner concentration in the two-component type developer is detected according to reduction of the image density, change of the inductance of the developer or change of the volume of the developer, and the toner is manually supplied. However, when the toner is manually supplied, the toner concentration is changed stepwise and it is difficult to adjust the toner concentration in the developer at a certain predetermined level. There is known an apparatus in which the toner concentration is detected and the toner is automatically supplied based on the detection signal. However, a complicated detection and control system is necessary for this apparatus and the apparatus is inevitably expensive, and also in this apparatus, the adjustment of the toner concentration is inevitably stepwise.

Furthermore, in this known toner concentration adjustment mechanism, if the toner concentration in the two-component type developer becomes higher than the predetermined level, the function of reducing the toner concentration cannot be attained.

SUMMARY OF THE INVENTION

It is a primary object of the present invention to provide a method and apparatus for automatically and continuously adjusting the toner concentration in a two-component type developer by simple means.

Another object of the present invention is to provide a toner concentration adjusting method and apparatus for always maintaining the toner concentration in a magnetic brush of a two-component type developer at a certain level.

Still another object of the present invention is to provide a method and apparatus for freely adjusting the toner concentration in a two-component type developer to an optional value within a broad range.

A further object of the present invention is to provide a toner concentration adjusting method and apparatus in which even if reduction of the toner concentration is locally caused on a magnetic brush on a developing sleeve by local consumption of the toner, the toner is supplied to the toner concentrationreduced portion so that the toner concentration is uniformalized as a whole.

In accordance with one fundamental aspect of the present invention, there is provided a method for adjusting the toner concentration of a two-component type developer comprising a mixture of a magnetic carrier and an electroscopic toner, said method comprising bringing a magnetic brush of the two-component type developer into sliding contact with a mesh screen to move the electroscopic toner toward the magnetic brush side or the opposite side through apertures of the mesh screen.

In accordance with another fundamental aspect of the present invention, there is provided an apparatus for adjusting the toner concentration in a two-component type developer, which comprises a mechanism for forming a magnetic brush comprising a mixture of a magnetic carrier and an electroscopic toner and delivering said magnetic brush, said mechanism including a support formed of an electroconductive non-magnetic material and a magnet having a plurality of poles and being built in the interior of the support, at least one of said support and magnet being movable, a mesh screen which is formed of an electroconductive material and arranged to support the electroscopic toner on the upper surface side thereof and to have sliding contact with the magnetic brush on the lower surface side thereof, and a bias voltage applying mechanism for applying a bias voltage between said support and mesh screen.

The foregoing and other objects, advantages and features of the present invention will become apparent from the following detailed description.

DETAILED DESCRIPTION OF THE PREFERRED EMBODIMENTS

Figure 1:
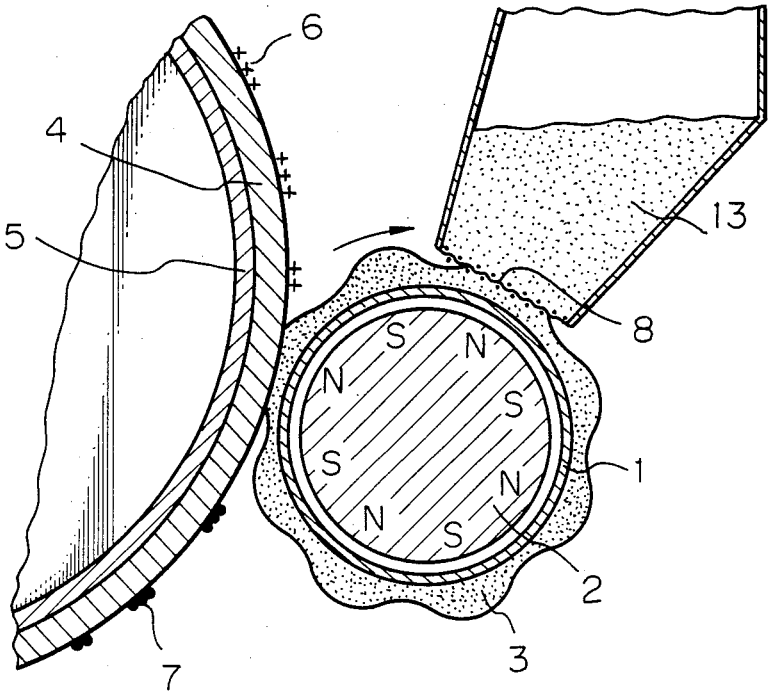
FIG. 1 is an arrangement diagram illustrating the principle of the present invention.

Referring to FIG. 1 illustrating the principle of the present invention, a magnetic roll 2 having a plurality of poles is contained within a sleeve 1 formed of a non-magnetic material, and the sleeve 1 and magnet roll 2 are supported on a machine frame (not shown) so that at least one of them can be rotated.

A magnetic brush comprising a two-component type developer composed of a mixture of a magnetic carrier and an electroscopic toner is formed on the surface of the sleeve 1. A rotary drum 5 having an electrophotographic photosensitive layer 4 is arranged in close proximity to the sleeve 1. The magnetic brush 3 on the sleeve 1 is moved, for example, in the direction indicated by the arrow in the drawings with rotation of the sleeve 1 or magnet roll 2 and is brought into sliding contact with the surface of the photosensitive layer 4 to form a toner image 7 corresponding to an electrostatic latent image 6 on the photosensitive layer 4.

Figure 2:
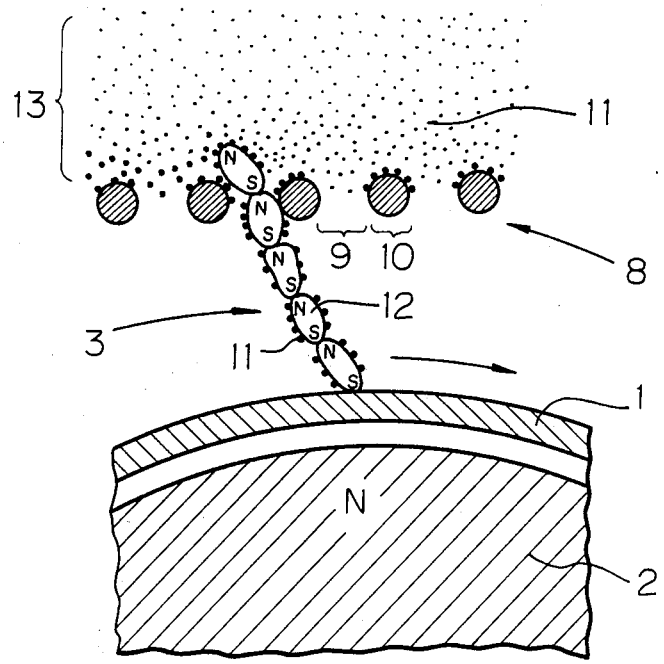
FIG. 2 is a diagram illustrating the state of sliding contact between a magnetic brush and a mesh screen.

According to the present invention, the magnetic brush 3 on the sleeve 1 is brought into sliding contact with a mesh screen 8. Referring to FIG. 2 which is an enlarged diagram showing the state of sliding contact between the magnetic brush 3 and the mesh screen 8, the mesh screen 8 has apertures 9 and mesh strands or screening parts 10 and the magnetic brush 3 has on the surface thereof chains of clusters of the magnetic carrier 12 on which toner particles 11 are electrostatically attracted and held. Only the toner particles 11 are stored on the upper side of the mesh screen 8, while only the magnetic brush 3 is located on the lower side of the mesh screen 3. In some case, the top end of the magnetic brush 3 protrudes to the upper side of the mesh screen 8 through the apertures 9.

The present invention is based on the finding that when the magnetic brush 3 is brought into sliding contact with the mesh screen 8 in the above-mentioned manner, the toner particles 11 are sucked or extruded through the mesh screen 8 according to the toner concentration in the two-component type developer forming the magnetic brush, whereby the toner concentration in the two-component type developer is automatically adjusted.

Figure 3:
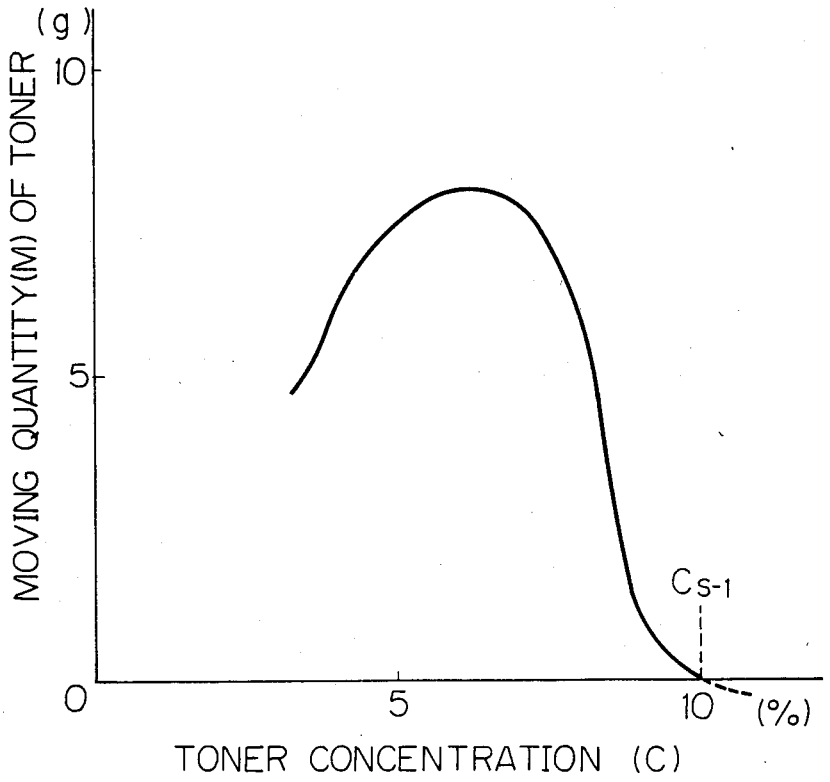
FIG. 3 is a graph illustrating the relation between the toner concentration and the moving quantity of the toner.

Referring to FIG. 3 illustrating the relation between the toner concentration (C) in the two-component type developer and the moving quantity (M) of the toner through the mesh screen, a positive value of the moving quantity of the toner indicates that the toner is moved from a toner reservoir 13 on the mesh screen 8 to the magnetic brush 3 through the screen 8, and a negative value of the moving quantity indicates that the toner is moved from the magnetic brush 3 to the toner reservoir 13 through the screen 8. Referring to the principle diagram of FIG. 3, when the toner concentration (C) of the two-component type developer is lower than a certain standard level $C_{s-1}$, movement of the toner from the toner reservoir 13 to the magnetic brush 3 through the screen 8 is caused, and when the toner concentration is higher than this standard level $C_{s-1}$, movement of the toner from the magnetic brush 3 to the toner reservoir 13 through the screen 8 is caused. When the toner concentration is equal to the standard level $C_{s-1}$, movement of the toner through the screen 8 is not caused. Furthermore, since the ratio of the change of the moving quantity in the vicinity of this standard level, that is, the gradient of the moving quantity of the toner in the vicinity of the standard level, is large, according to the present invention, the adjustment of the toner concentration in the two-component type developer can be accomplished promptly and precisely according to the change of the toner concentration.

Figure 4:
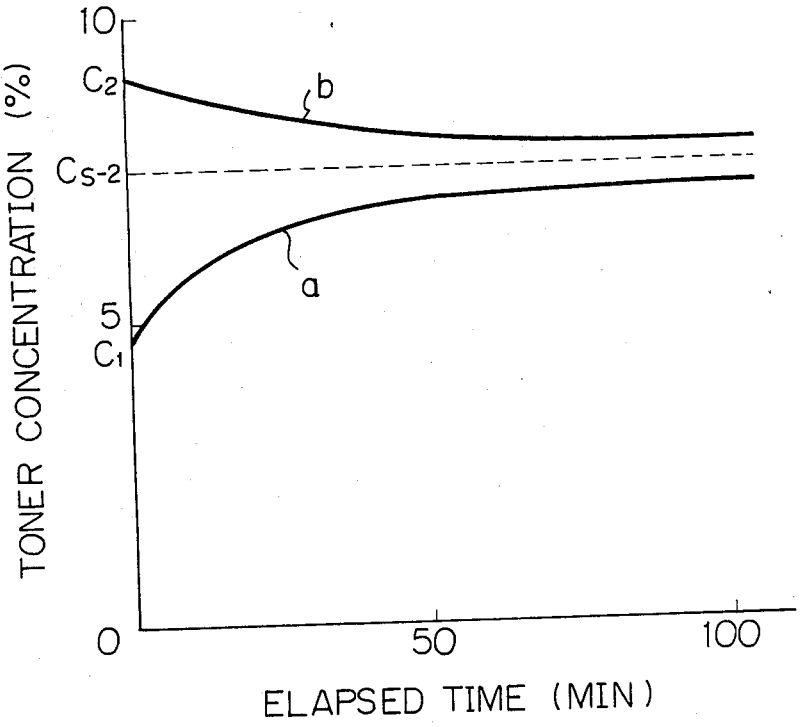
FIG. 4 is a graph illustrating the relation between the elapsed time and the toner concentration.

FIG. 4 is a graph showing the relation between the toner concentration (C) and the elapsed time (t) in the toner concentration adjusting method according to the present invention. From FIG. 4, it is seen that when the toner concentration (C) is either at a level $C_1$ lower than the standard value $C_{s-2}$ or at a level $C_2$ higher than the standard value $C_{s-2}$, with the lapse of time, the toner concentration converges on the standard concentration $C_{s-2}$.

It has not been elucidated why extrusion of the toner from the magnetic brush 3 or suction of the toner into the magnetic brush 3 is performed through the mesh screen 8 in the present invention. However, it is conjectured that this phenomenon will probably take place for the following reasons.

As pointed out hereinbefore, the electroscopic toner particles 11 are attracted and held on the surface of the magnetic carrier 12 by an electrostatic force to form a magnetic brush 3. The mesh screen 8 allows contact and mutual friction between the magnetic carrier 12 forming the magnetic brush 3 and the toner particles 11 in the toner reservoir 13 through the apertures 9 of the mesh screen 8, and it is believed that the mesh strands or screening parts 10 of the mesh screen 8 act as a scraper and exert a function of scraping out the toner particles 11 from the magnetic brush 3. Accordingly, in the case where the toner concentration in the magnetic brush is low, the toner particles 11 are electrostatically attracted into the magnetic brush through the apertures of the mesh screen, and in the case where the toner concentration in the magnetic brush is high, excessive toner particles are scraped out from the magnetic brush and stored on the mesh screen.

Figure 5:
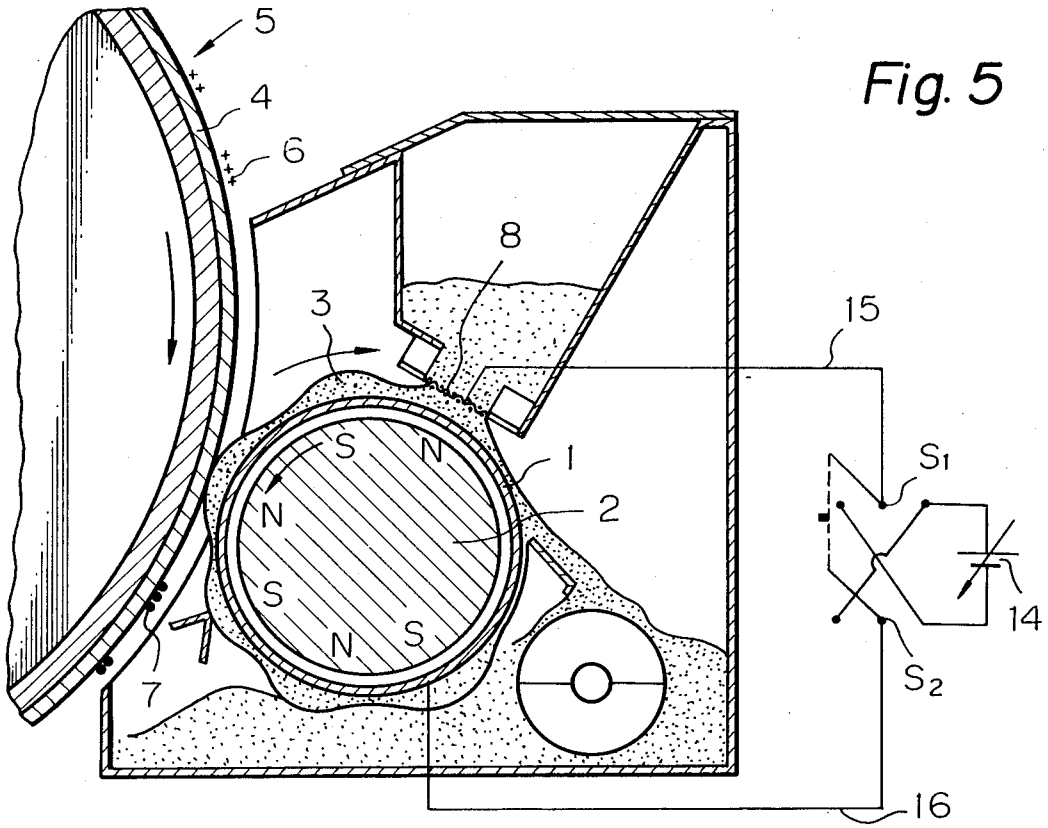
FIG. 5 is an arrangement diagram illustrating a preferred embodiment of the present invention.

In accordance with one preferred embodiment of the present invention, as diagrammatically illustrated in FIG. 5, a bias voltage is applied between the mesh screen 8 and the magnetic brush support, that is, the sleeve 1.

In this embodiment, a voltage-adjustable variable direct current power supply 14 is arranged. This power supply 14 is connected to the mesh screen 8 through a contact S1 of a double-throw dipolar switch and a connecting line 15 and also to the sleeve 1 through a contact S2 of the above-mentioned switch and a connecting line 16. Accordingly, a positive or negative bias voltage based on the sleeve 1 is applied by changeover of the switch, and the intensity of this bias voltage is freely adjustable.

This embodiment is based on the finding that when the magnetic brush 3 is brought into sliding contact with the mesh screen 8, according to the toner concentration in the two-component type developer forming the magnetic brush, the toner particles 11 are attracted or extruded through the mesh screen 8 and when a bias voltage is applied between the sleeve 1 supporting the magnetic brush and the mesh screen 8, the moving quantity of the toner and the toner concentration in the magnetic brush which causes no substantial movement of the toner (hereinafter referred to as "standard concentration $C_s$") are changed according to the polarity and intensity of this bias voltage.

As pointed out hereinbefore, if the toner concentration is either lower or higher than the standard concentration $C_s$, movement of the toner through the mesh screen is caused and the toner concentration converges on the standard concentration $C_s$. As is seen from curves a and b in FIG. 6, if a bias voltage based on the sleeve is applied between the mesh screen and sleeve, the standard concentration can be shifted to a higher or lower level than the level attained in the absence of the bias voltage (curve c in FIG. 6) according to the polarity and intensity of the bias voltage.

Figure 7:
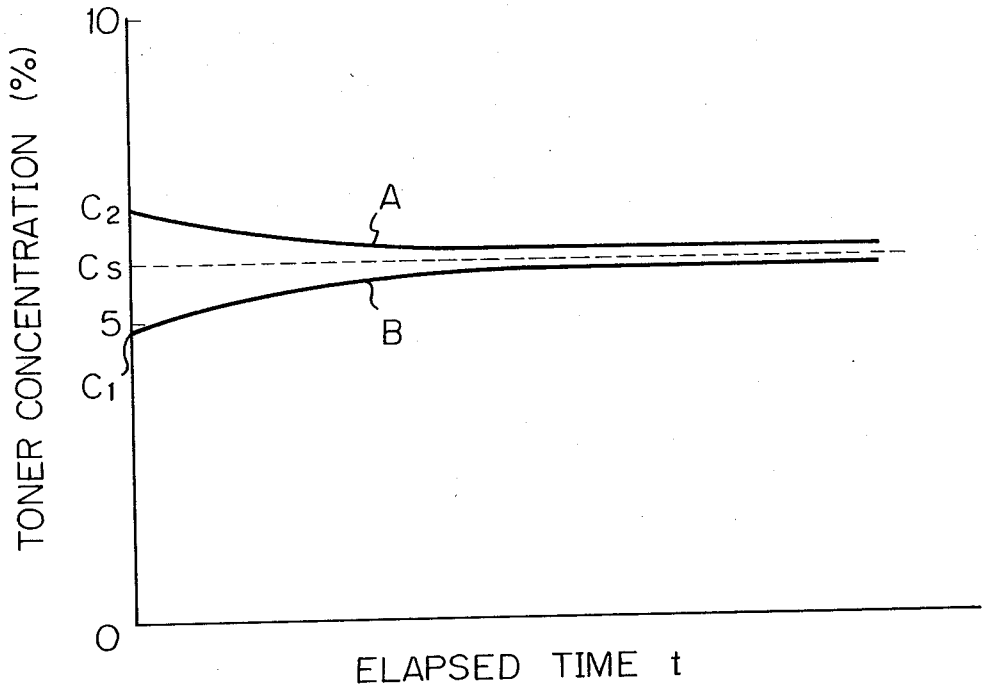
FIGS. 7 and 8 are graphs illustrating the relation between the toner concentration in a magnetic brush and the elapsed time, which is observed when a bias voltage is applied between a mesh screen and a sleeve.
Figure 8:
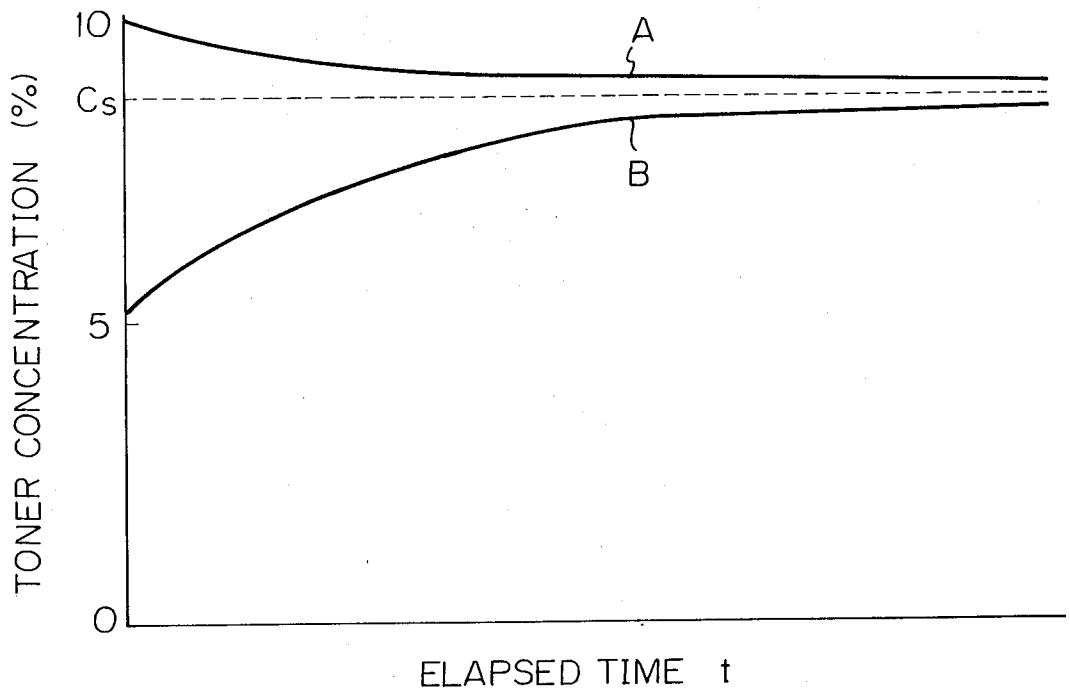

FIGS. 7 and 8 are graphs illustrating the relation between the toner concentration in the magnetic brush and the elapsed time. In FIGS. 7 and 8, curve A shows the relation observed when the initial toner concentration in the magnetic brush is higher than the standard concentration $C_s$, and curve B shows the relation observed when the initial toner concentration in the magnetic brush is lower than the standard concentration $C_s$. FIG. 7 shows the results obtained when the applied voltage is +100 V and FIG. 8 shows the results obtained when the applied voltage is −150 V. From FIGS. 7 and 8, it will readily be understood that even if the toner concentration (C) is either higher (curve A) or lower (curve B) than the standard level $C_s$, the concentration converges on the standard concentration $C_s$ with the lapse of time and that when the bias voltage of the negative polarity, the standard concentration $C_s$ is located on a higher concentration side and when the bias voltage is of the positive polarity, the standard concentration $C_s$ is located on a lower concentration side.

As is apparent from the foregoing description, according to this preferred embodiment of the present invention, in the case where a bias voltage is applied to the mesh screen 8 having sliding contact with the magnetic brush 3 of the developer on the sleeve 1 and this developer comprises a toner for developing a positively charged latent image, by increasing the bias voltage on the side of the negative polarity, the toner concentration in the magnetic toner can be shifted to the higher concentration side, or by shifting the bias voltage to the side of the positive polarity, the toner concentration in the magnetic brush is changed to the lower concentration side.

Of course, in the case where the two-component type developer comprises a toner for developing a negatively charged latent image, in contrast to the above-mentioned case, by increasing the bias voltage on the positive side, the toner concentration in the magnetic brush is shifted to a higher concentration side, or by shifting the bias voltage to the negative side, the toner concentration is changed to the lower concentration side.

Accordingly, in this preferred embodiment of the present invention, by adjusting the intensity of the bias voltage and optionally the polarity thereof, the toner concentration in the magnetic brush is precisely adjusted to an optional predetermined level within a considerably broad range automatically and continuously. The reason why the toner concentration is adjusted to the standard concentration $C_s$ while applying the bias voltage is considered to be as follows.

In case of a toner for developing a positively charged latent image, the toner particles are negatively charged, and when a negative bias voltage is applied to the mesh screen, a repulsive force of pushing the toner particles 11 (see FIG. 2) toward the sleeve 1 or carrier 12 of the opposite polarity (see FIG. 2) is imposed on the mesh screen 8, with the result that suction of the toner through the mesh screen 8 is increased. On the contrary, when a positive bias voltage is applied, an attracting force is produced between the negatively charged toner particles 11 and the mesh screen 8, with the result that suction of the toner to the mesh screen 8 is controlled.

The size of the apertures 9 of the mesh screen 8 is determined so that the aperture size is larger than the particle size of the electroscopic toner 11 but is smaller than the size allowing the toner 11 to freely fall down by the gravity when the electroscopic toner 11 is placed on the mesh screen 8. It is difficult to generally define the concrete size of the apertures 9 because the aperture size differ according to the particle size of the toner particles and the flowability (the angle of repose) of the toner.

Commercially available two-component type developers ordinarily comprise a relatively coarse magnetic carrier having a particle size of 10 to 200 microns and a relatively fine electroscopic toner having a particle size of 1 to 40 microns, and in many cases, the electroscopic toner particles are prepared by the kneading and pulverization method and they have an indeterminate shape and are relatively poor in the flowability. It has been found that in the case where these commercially available two-component type developers are used, satisfactory results can be obtained by using a mesh screen having an aperture size of 50 to 500 mesh (Tyler standard), preferably 80 to 200 mesh, especially preferably 100 to 150 mesh. Ordinary two-component type magnetic developers comprises a toner in an amount of 3 to 20% by weight based on the sum of the toner and magnetic carrier. If a mesh screen having the above-mentioned aperture size is used, the standard toner concentration $C_s$ (see FIGS. 3 and 4 and 7 and 8) can be set within this range.

Of course, the standard toner concentration $C_s$ is changed to some extent according to the aperture size of the mesh screen or the degree of sliding contact with the magnetic brush or according to whether or not the bias voltage is applied. Ordinarily speaking, increase of the aperture size of the mesh screen results in shifting of the standard concentration $C_s$ to a higher concentration side, and increase of the degree of sliding contact of the screen with the magnetic brush results in shifting of the standard concentration $C_s$ to a lower concentration side.

When a bias voltage is applied between the mesh screen and the sleeve, this voltage can optionally be changed within a range not causing a trouble such as discharge breakdown, and it is ordinarily preferred that the bias voltage be in the range of from −500 V to +500 V, especially from −200 V to +200 V.

The material of the mesh screen is not particularly critical in the present invention. For example, there may be used non-magnetic metal materials such as stainless steel, brass, copper, bronze, phosphor bronze, aluminum and Monel metal, magnetic metal materials such as nickel, zinc-deposited steel and hard steel, and organic polymeric materials such as nylon, polyester, polyvinyl chloride, vinylidene chloride resin, acrylic resin and silk. Of the foregoing materials, electrically insulting materials may be used after the conducting treatment when a bias voltage is applied.

The screen may be a so-called woven net formed of a plain weave or twill fabric of a fiber or wire of a material as described above, a punched net formed by punching a material as described above or an electroformed net obtained by electroforming of a metallic material. The aperture ratio of the mesh screen, that is, the area of the apertures to the total area of the screen, is ordinarily 20 to 80%, preferably 35 to 70% and especially preferably 40 to 50%, and the aperture ratio is appropriately determined while taking the mechanical strength and durability of the screen and the rapidity of the adjustment of the toner concentration into consideration.

The toner concentration adjusting method of the present invention may be directly applied to a magnetic brush roller for the development of an electrostatic latent image so as to adjust the toner concentration in the developer. Furthermore, the method of the present invention may be applied to a roller for cleaning by the magnetic brush so as to separate or recover the toner from the cleaning magnetic toner.

As will be apparent from the foregoing description, according to the present invention, the toner concentration can be controlled precisely and automatically only by a simple operation of bringing the mesh screen into sliding contact with the magnetic brush without using any particular detecting or controlling mechanism. This advantage is further enhanced when a bias voltage is applied between the screen and the support for the magnetic brush.

The present invention will now be described with reference to the following Examples that by no means limit the scope of the invention.

EXAMPLE 1

A measurement vessel provided on the bottom thereof with a 100-mesh brass screen having a size of 20 mm×12 mm was prepared, and 0.5 g of a toner was charged in the vessel. The screen was appropriately contacted with ears of a magnetic brush of a two-component type developer in which the toner concentration was set at a relatively low level. The weight of the vessel was measured at intervals of 60 seconds, and based on the difference between the initial weight of the vessel and the weight of the vessel after the lapse of a certain time, the relation between the toner cnccentration in the developer and the amount of the toner supplied to the magnetic brush through the mesh screen was examined. Incidentally, the toner concentration was determined according to the washing method using 1 g of the sample collected from the magnetic brush at the portion falling in contact with the drum.

The brass mesh screen was connected to a bias source so that the voltage applied between the developing sleeve and mesh screen was optionally set.

Figure 6:
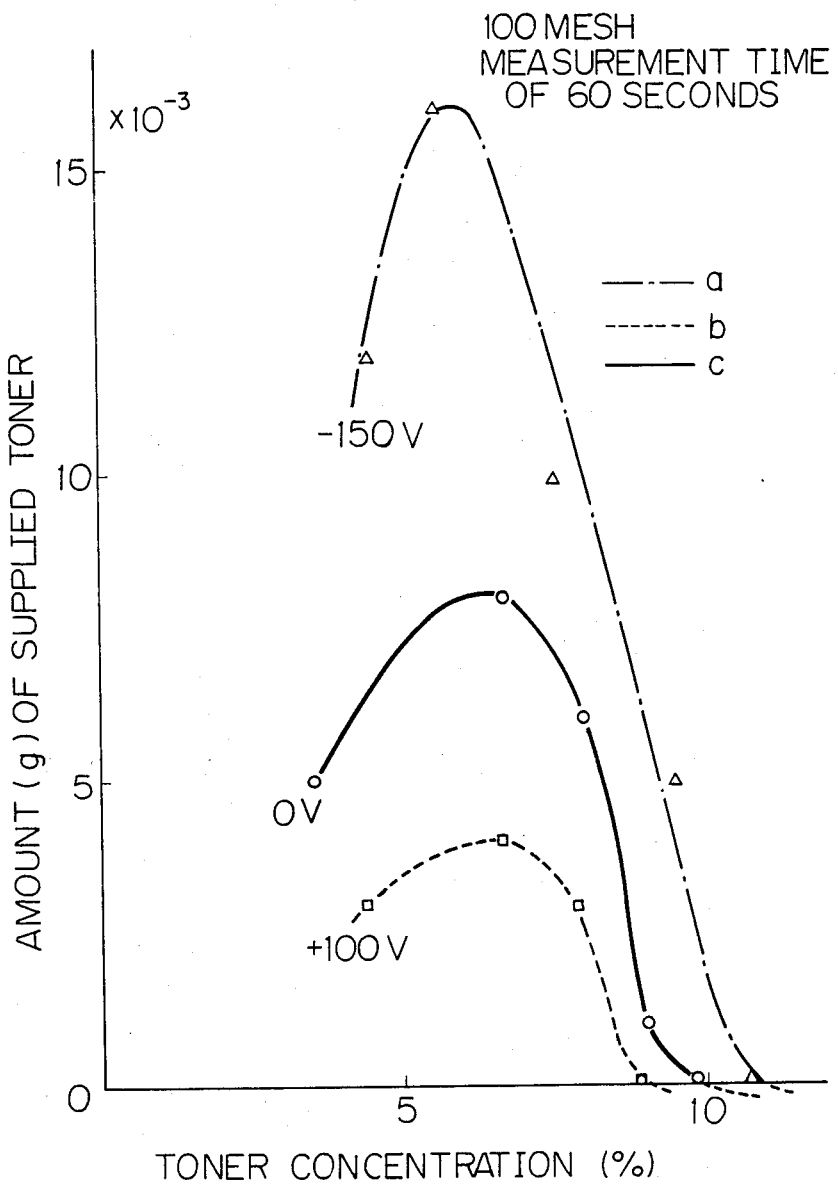
FIG. 6 is a graph illustrating the relation between the toner concentration and the moving quantity of the toner, which is observed when a bias voltage is applied between a mesh screen and a sleeve.

The obtained results are shown in FIG. 6.

From FIG. 6, it is seen that the amount supplied of the toner was changed according to the toner concentration in the developer and was also changed according to the bias voltage between the developing sleeve and the mesh screen.

From FIG. 6, it also is seen that the amount supplied of the toner converged to the toner concentration of about 6%.

At this experiment, the toner having a negative polarity was used. There were found great differences of the amount supplied of the toner and the toner concentration at the stoppage of the supply of the toner among the mesh screen voltages of +100 V, 0 V and −150 V. Namely, the toner concentration at the stoppage of the supply of the toner was about 9% at the mesh screen voltage of +100 V, about 10% at the mesh screen voltage of 0 V or about 11% at the mesh screen voltage of −150 V.

EXAMPLE 2

A mesh screen of the same kind as used in Example 1 was attached to the bottom of a toner hopper along the entire length of a developing roller in the axial direction in a testing developing apparatus (constructed by remodeling a developing apparatus Model DC-161 supplied by Mita Industrial Co., Ltd.), so that the mesh screen was brought into contact with a magnetic brush formed on the roller.

The initial toner concentration in the magnetic brush was set at a level $C_1$ lower than the predetermined level, and the relation between the toner concentration and the elapsed time was examined. The obtained results are indicated by curve a in FIG. 4.

EXAMPLE 3

The procedures of Example 2 were repeated in the same manner except that the initial toner concentration in the magnetic brush was set at a level $C_2$ higher than the predetermined level, and the relation between the toner concentration and the elapsed time. The obtained results are indicated by curve b in FIG. 4.

EXAMPLE 4

A mesh screen (12 mm×230 mm) of the same kind as used in Example 1 was attached to the bottom of a toner hopper along the entire length of a developing roller in the axial direction in a testing developing apparatus (constructed by remodeling a developing apparatus Model DC-161 supplied by Mita Industrial Co., Ltd.), so that the mesh screen was brought into contact with the magnetic brush formed on the roller.

The initial toner concentration was set at a level $C_1$ lower than the predetermined level and the mesh screen was adjusted to +100 V, and the relation between the toner concentration and the elapsed time was examined. The obtained results are indicated by curve B in FIG. 7.

EXAMPLE 5

The procedures of Example 4 were repeated in the same manner except that the initial toner concentration was set at a level $C_2$ higher than the predetermined level and the screen voltage was adjusted to +100 V, and the relation between the toner concentration and the elapsed time was examined. The obtained results are indicated by curve A in FIG. 7.

From curves A and B given in FIG. 7, it is seen that whether the initial toner concentration is higher or lower than the standard level $C_s$, the toner concentration converges on $C_s$ after the lapse of a certain time.

EXAMPLES 6 and 7

The procedures of Example 4 were repeated in the same manner except that the mesh screen voltage was changed to −150 V and the initial concentration in the magnetic brush was set at 10% (Example 6) or 5% (Example 7). The obtained results are indicated by curve A (Example 6) and curve B (Example 7) in FIG. 8. From the results shown in FIG. 8, it is seen that if a bias voltage is applied to the mesh screen, the level $C_s$ on which the toner concentration in the developer converges can optionally be controlled.

We claim:

1. An apparatus for adjusting the toner concentration in a two-component type developer, which comprises a mechanism for forming a magnetic brush comprising a mixture of a magnetic carrier and an electroscopic toner and delivering said magnetic brush, said mechanism including a support formed of an electroconductive non-magnetic material and a magnet having a plurality of poles and being built in the interior of the support, at least one of said support and magnet being movable, mesh screen which is formed of an electroconductive material and arranged to support the electroscopic toner on the upper surface side thereof and to have sliding contact with the magnetic brush on the lower surface side thereof, and a bias voltage applying mechanism for applying a bias voltage between said support and mesh screen, and adjusting means for adjusting the polarity and intensity of the bias voltage to set a standard toner concentration of the magnetic brush, said standard toner concentration being defined as the toner concentration where the moving quantity of the toner through the mesh screen is substantially zero, wherein the toner concentration of the magnetic brush is adjusted by moving the toner toward the magnetic brush side through apertures of the mesh screen when the toner concentration is lower than the standard toner concentration and by moving the toner toward the opposite side when the toner concentration is higher than the standard toner concentration.

2. A method for adjusting the toner concentration of a two-component type developer comprising a mixture of a magnetic carrier and an electroscopic toner, which comprises (i) bringing a magnetic brush of the two-component type developer on a support into sliding contact with a mesh screen formed of an electroconductive non-magnetic material, (ii) applying a bias voltage between the mesh screen and the magnetic brush support, (iii) adjusting the polarity and intensity of the bias voltage to set a standard toner concentration of the magnetic brush, said standard toner concentration being defined as the toner concentration where the moving quantity of the toner through the mesh screen is substantially zero, and (iv) adjusting the toner concentration of the magnetic brush by moving the toner toward the magnetic brush side through apertures of the mesh screen when the toner concentration is lower than the standard toner concentration and by moving the toner toward the opposite side when the toner concentration is higher than the standard toner concentration.

3. A method according to claim 2, wherein the mesh screen has an aperture size larger than the particle size of toner particles but smaller than a size allowing the toner particles to freely fall down by the gravity when the toner is placed on the screen.

4. A method according to claim 2, wherein the mesh screen has an aperture size of 70 to 200 mesh.

5. The method of claim 2 wherein the bias voltage applied between the mesh screen and the magnetic brush support is in the range of from −500 V to +500 V.

6. The method of claim 2 wherein the bias voltage applied between the mesh screen and the magnetic brush support is in the range of from −200 V to +200 V.

* * * * *

UNITED STATES PATENT AND TRADEMARK OFFICE

CERTIFICATE OF CORRECTION

PATENT NO. : 4,576,465

DATED : March 18, 1986

INVENTOR(S) : AKIRA FUSHIDA, ET AL.

It is certified that error appears in the above-identified patent and that said Letters Patent is hereby corrected as shown below:

IN THE CLAIMS

Claim 1, line 10, (column 9, line 23)
insert --a-- before "mesh".

Signed and Sealed this

*Seventeenth* Day of *June 1986*

[SEAL]

*Attest:*

DONALD J. QUIGG

*Attesting Officer*

*Commissioner of Patents and Trademarks*